United States Patent [19]

Lamort

[11] Patent Number: 4,898,665

[45] Date of Patent: Feb. 6, 1990

[54] SCREENS FOR PAPER PULP PURIFIERS

[75] Inventor: Jean-Pierre Lamort, Vitry Le Francois, France

[73] Assignee: E & M Lamort, Vitry Le Francois, France

[21] Appl. No.: 177,502

[22] Filed: Apr. 4, 1988

[30] Foreign Application Priority Data

Apr. 6, 1987 [FR] France ..... 87 04833

[51] Int. Cl.[4] ..... B07B 1/04

[52] U.S. Cl. ..... 209/273; 209/17; 209/393

[58] Field of Search ..... 209/17, 268, 273, 324, 209/358, 363, 608, 393, 240, 270, 304, 399

[56] References Cited

U.S. PATENT DOCUMENTS

| | | | |
|---|---|---|---|
| 2,038,931 | 4/1936 | Goldberg et al. | 209/268 X |
| 2,827,169 | 3/1958 | Cusi | 209/268 X |
| 3,617,008 | 11/1971 | Lamort . | |
| 3,939,065 | 2/1976 | Ahlfors | 209/240 |
| 4,309,284 | 1/1982 | Morimoto et al. | 209/273 |
| 4,405,450 | 9/1983 | Selder | 209/17 X |
| 4,529,520 | 7/1985 | Halstrom . | |

FOREIGN PATENT DOCUMENTS

| | | | |
|---|---|---|---|
| 3023746 | 1/1982 | Fed. Rep. of Germany | 209/363 |
| 629799 | 11/1927 | France | 209/17 |
| WO83/02292 | 7/1983 | World Int. Prop. O. . | |

*Primary Examiner*—Joseph J. Rolla

*Attorney, Agent, or Firm*—Darby & Darby

[57] ABSTRACT

A screening device is provided with a screening element having a plurality of perforations going therethrough. Each perforation has an inlet and an outlet.

The screen element includes a plurality of step-type obstacle members positioned in the vicinity of the inlets of the perforations to produce turbulence in a flow of a fluid passing through the perforations. Each obstacle member has a shielding member positioned substantially above the inlet so that a gap is defined between the shielding member and the screening element. The shielding element extending over the inlet of the perforation forms an entry baffle above the outlet.

At least one blade having a hydrodynamic profile rotates at high speed above the shielding element.

13 Claims, 3 Drawing Sheets

SCREENS FOR PAPER PULP PURIFIERS

Figure 1:
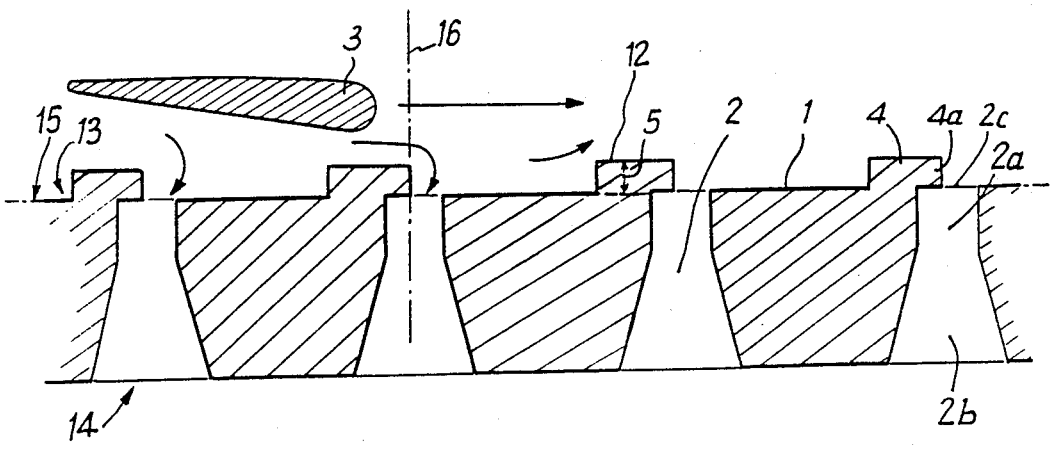

The present invention is an improvement in the screens with holes or slots for the purification of paper pulp and in the separators or purifiers equipped with such screens.

We are familiar with the embodiment of paper pulp purifiers incorporating a separation or purification surface provided with calibrated holes or slots, in front of which a hydrodynamically profiled blade circulates at high speed, creating pulsations in the vicinity of the holes or slots with each pass, in order to prevent the clogging of the said holes or slots; the pulp is entrained by the movement of the blade and also circulates at high speed in front of the screen.

In order to improve the working of the screen, in other words the separation of the fibers and the impurities contained in the pulp, obstacles have been disposed on the surface of the screen facing the blade, to break up the component parallel to the surface of the screen, of the speed of the liquid. Such obstacles are usually embodied by milling a sheet of stainless steel: in the draw formed by the obstacles, the holes or slots are then made. These perforations must become wider on the downstream side in the manner of a diffuser and they are produced in two operations: milling the diffusion cone, then drilling. One of the difficulties resides in the positioning of the perforations relative to the obstacle. And as it turns out, this positioning has great influence on the efficiency of the screening.

This problem of positioning has been solved in part by embodying the screens by juxtaposition of identical bars held by crosspieces assembled with or without welding.

It also happens that the height of the obstacle, relative on the one hand to the position of the perforation and to its dimension transversely to the obstacle, and on the other, to the rate of circulation of the pulp, has a great deal of influence.

Each of these factors, indeed, acts on the fluidisation of the pulp on the upstream surface of the screen and on the resistance to passage of the fibers, and quite often the improvement of one screening factor (flow, for example), is obtained to the detriment of another factor (for example the resistance to passage of the fibers leads to a variation in the concentration).

By way of example, screens incorporating an obstacle in the vicinity of each perforation, whether produced by juxtaposition of bars with spur downstream, or by machining sheet metal, have, in comparison with screens with obstacle distant from the perforation or perforations, a greater flow of screened pulp and a less thickened emerging pulp, but this is to the detriment of the quality of the screening which is lower.

The object of the invention is a screen that increases the fluidisation of the pulp on its upstream surface, and reduces the resistance to passage of the fibers.

The subject of the invention is a screening device for a purifier or separator, in particular for a purifier of paper pulp, incorporating a perforated surface, the perforations having an axis that is in general substantially perpendicular to the said surface, of the type with calibrated slots or holes, at least one hydrodynamically profiled blade circulating at high speed in front of the perforated surface, whose function is to entrain the pulp in movement and to unclog the perforations, the said surface being provided with obstacles on the side facing the blade in order to create turbulence in the movement of the pulp, characterized in that the part of the obstacle closest to the blade has a plane face parallel to the plan of the perforated surface and in that the obstacles project into the perforations so that each perforation is partly covered by the end of the obstacle. The invention is further remarkable for the following features:

- the bottom part of the obstacle is raised relative to the opposed edge of the perforation so that in vertical cross section the plane of entry into the zone of access to the perforation forms an angle with the horizontal that is greater than 0° and less than or equal to 90°.
- the end of the obstacle overhangs the opposite edge of the perforation in order to cover the entry section of the perforation so that in vertical cross section the plane of entry of the zone of access to the perforation passes through an angle alpha to the horizontal that is greater than 90°.
- the height of the obstacle is on the order of several tenths of a millimeter between 0.2 and 1 mm.
- the width of the entry section of the perforation is comprised between 0.1 and 1 millimeter.

The screen thus constituted produces turbulence in a very small space, on the order of a cubic millimeter and presents the entry of the perforations normally to the direction of the turbulent current, which promotes the circulation of the pulp in the perforations.

This screen offers the following advantages:

- increased purification capacity (flow of incoming pulp),
- improved quality of purification with a given capacity: the purification is finer,
- reduced rate of rejects with
  - reduced thickening factor: the concentration of outgoing dry material varies little, and the thickening of the rejected part of the pulp is minor.
  - reduced level of long-fiber rejects
  - higher concentration of contaminants in the rejects, This screen, therefore, permits reducing the number of purification stages and the consumption of water necessary to dilute the rejects usually thickened on leaving the purifier.

Figure 2:
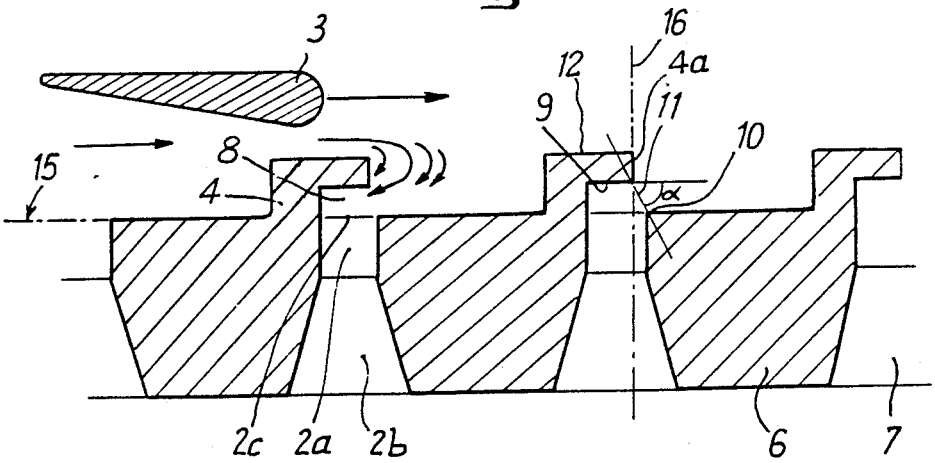
Figure 3:
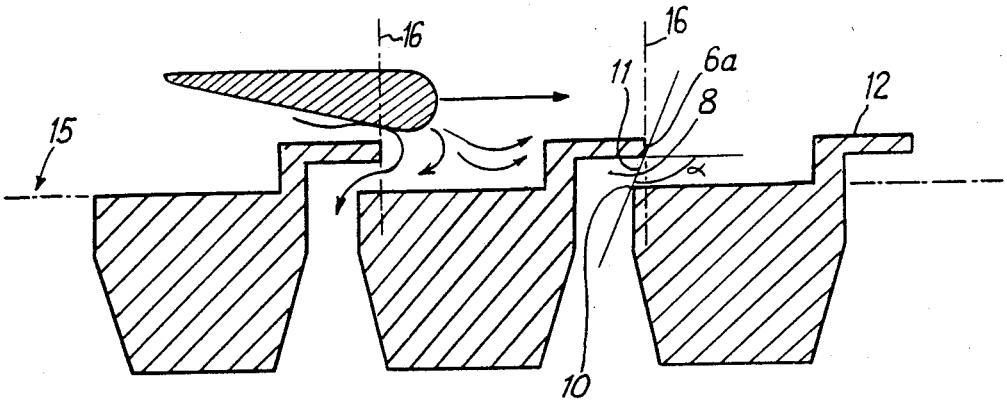
Figure 4:
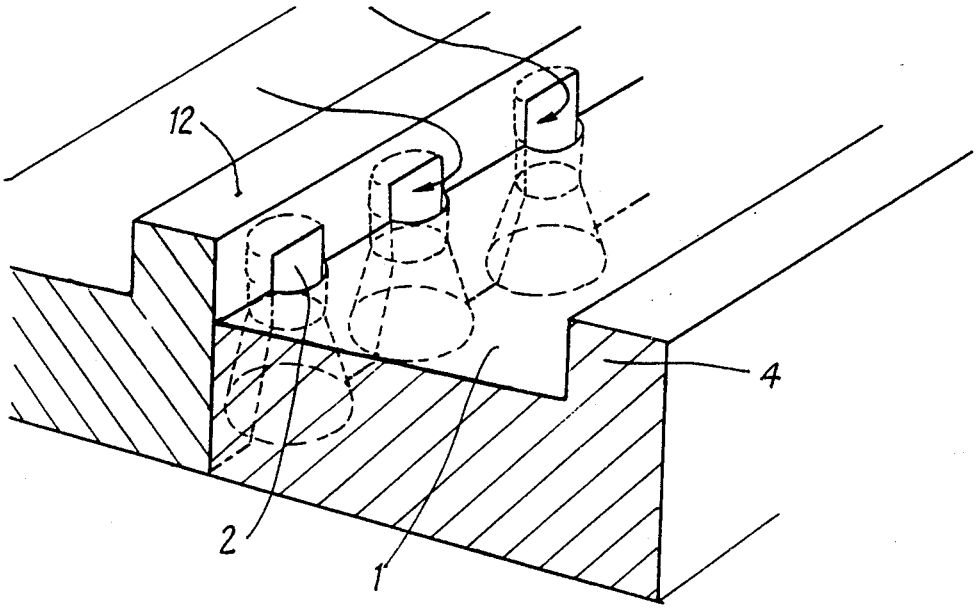
Figure 5:
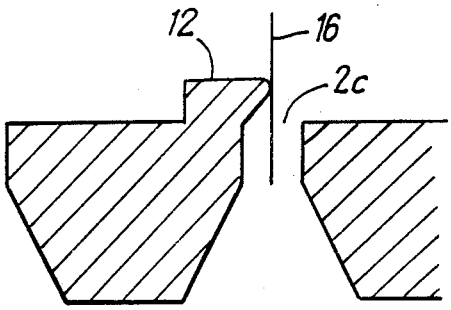
Figure 6:
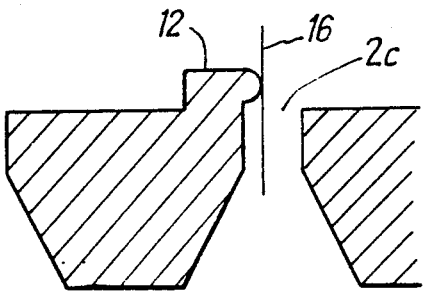

By way of example, and for a better understanding of the invention, the attached drawing shows:

in FIG. 1, a schematic view in vertical cross section of a screen according to the invention, in FIG. 2, a schematic view in vertical section of a variation of FIG. 1, in FIG. 3, a schematic view in vertical cross section of a second variation of FIG. 1, in FIG. 4, a perspective view of a portion of a screen according to the variation in FIG. 2, in FIGS. 5 and 6, variations of ends of obstacles according to the invention.

The screening device illustrated in the figures comprises, on the one hand:

a screen constituted by a metal surface 1 comprising perforations 2. The latter are slots or holes having, in cross section, according to the state of the art, from one side 13 to the other 14 of the surface 1, a narrow first part **2*a*, with parallel sides 2*d*, with axis generally perpendicular to the surface of the screen, and with an entry section 2*c* parallel to the surface of the screen, followed by a second part that widens toward the outlet, forming a trapezoidal section 2*b*. In the case of perforations in the form of holes, this second part 2b** is a truncated cone; and on the other hand:

a blade or foil with hydrodynamic profile circulating at high speed in front of the face 13 of the screen, parallel to this face, in the direction indicated by the arrow in the figures.

The movement of the blade 3 is imparted to the pulp circulating along the surface of the screen, and the good pulp gradually passes through the perforations from the upstream side 13 to the downstream side 14.

The front face 13 of the screen comprises obstacles 4 to break up the speed component parallel to the speed of the liquid.

The obstacles 4 are disposed in front of each perforation 2 in order to produce turbulence in the flow of the liquid for each perforation. These obstacles 4 often have varied profiles but as a rule they have a generally parallelopipedic or trapezoidal shape.

According to the invention these obstacles 4 are disposed so that:

(1) the part 12 of the obstacle closest to the blade has a plane face parallel to the plan of the perforated surface 1, (2) their end 4a, downstream relative to the direction of flow of the liquid, that is to say, the end immediately preceding the perforation, projects into the perforation 2, the section 2c of the said perforation thus being somewhat concealed by the projecting part 4a of obstacle 4.

The purpose of this arrangement is to promote the formation of turbulence applied around the end of the obstacle, and to guide the flow directly into the perforation 2.

In addition, the height 5 of the obstacle is on the same order of size as the width of the perforation (the diameter in the case of holes), that is to say, several tenths of a millimeter. The height of the obstacle, within the sense of the invention, is the distance between the plan 15 defined by the surface 1 of the screen and the face 12 parallel to the said plan. Preferably, the height of the obstacle is comprised between 0.2 and 1 millimeter, and the width of the entry section 2c of the perforation is comprised between 0.1 and 1 millimeter, but both may vary independently. This characteristic, in fact, when combined with these orders of size, appears to promote the formation of turbulence developing in the space determined by the height of the obstacle and the perforation section, that is to say, in a very small space.

Such screens can be formed by machining the perforated metal sheet, the obstacle 4 being integrated in the mass of the screen, the upper profile of the obstacle being obtained by milling, the perforation being obtained in a second pass.

They can also be formed by assembly of bars 6 on crosspieces 7, with or without juxtaposition of the ones against the others, this embodiment making it possible to use a variety of bar profiles.

According to a first variation of embodiment illustrated in FIG. 1, the obstacle has a projecting, downstream end 4a projecting into the section 2c itself. Section 2c in this case is slightly diminished by the projecting part 4a.

According to a variation of embodiment illustrated in FIG. 2, the obstacle has a projecting downstream part 4a which rises above the entry section 2c of the perforation, and partly caps it, thereby forming an entry baffle in front of the perforation, called the zone 8 of access to the perforation. The bottom part 9 of the obstacle is raised relative to the base surface of the screen, that is to say, relative to the opposite edge 10 of the perforation so that the plan of entry 11 into the zone of access is inclined to the horizontal by an angle alpha comprised between 0° and 90°.

In a third variation of embodiment illustrated in FIG. 3, the obstacle 4 covers perforation 2 entirely; it overhangs at least slightly the opposite edge 10 of the perforation; in this variation the baffle thus formed has a plan of entry inclined to the horizontal by an angle alpha greater than 90°.

Of course, the form of the end 4a can vary and can exhibit a more or less angular, or even rounded contour, as illustrated in FIGS. 5 and 6; as a result it is not always possible to measure the precise inclination of the plan of entry 11 in the access zone. What is essential, in the sense of the invention, is that plan 16 tangent to the end 4a of obstacle 4 and perpendicular to the entry section 2, that is to say, plan 15:

in the first and second variations, pass into the entry section 2c of perforation 2;

in the third variation, of over hang in FIG. 3, pass beyond the entry section 2c of the perforation.

I claim:

1. A screening device, comprising:

a screening element with a perforated surface and a plurality of perforations each passing through said screening element, each of said perforations having an inlet at said perforated surface and an outlet spaced from said perforated surface;

means for producing turbulence in a flow of fluid passing through said perforations and for directing the flow directly into said perforations, said producing and directing means including a plurality of obstacles, each of said obstacles extending from an area on said perforated surface that is upstream of a respective one of said inlets and further extending into an area that is over at least a portion of said respective one of said inlets so as to constitute an entry baffle; and a hydrodynamic profiled blade for preventing said perforations from clogging, said blade being arranged upstream of said perforations and obstacles and being rotatable for creating pulsations of flow into said perforations with each pass.

2. Screen according to claim 1, characterized in that the height (5) of the obstacle (4) is comprised between 0.2 and 1 millimeter.

3. Screen according to claim 1, characterized in that the width of the entry section (2c) of the perforation is comprised between 0.1 and 1 millimeter.

4. A screening device according to claim 1, wherein each of said obstacles have a plane surface parallel to said perforated surface and a remaining portion, said plane surface being closer to said blade than said remaining portion.

5. Screen for a purifier according to claim 1, characterized in that the bottom part (9) of the obstacle (4) is raised relative to the opposite edge (10) of the perforation so that in vertical cross section the plan of entry (11) in the zone of access (8) to the perforation will form an angle alpha to the horizontal that is greater than 0 andless than or equal to 90°.

6. Screen according to claim 5, wherein the height (5) of the obstacle (4) is comprised between 0.2 and 1 millimeter.

7. Screen according to claim 5, wherein the width of the entry section (2c) of the perforation is comprised between 0.1 and 1 millimeter.

8. Screen for a purifier according to claim 1, characterized in that the end (4*a*) of the obstacle overhangs the opposite edge (10) of the perforation (2) to cover the entry section (2*c*) of the perforation so that in vertical cross section the entry plan (11) of the access zone (8) to the perforation will pass through an angle alpha greater than 90° to the horizontal.

9. Screen according to claim 8, wherein the height (5) of the obstacle (4) is comprised between 0.2 and 1 millimeter.

10. Screen according to claim 8, wherein the width of the entry section (2*c*) of the perforation is comprised between 0.1 and 1 millimeter.

11. A screening device according to claim 1 wherein said obstacle member projects over the entire inlet of the perforation and extends substantially beyond the boundaries of the inlet.

12. A screening device according to claim 1, wherein said inlets each have a substantially cylindrical configuration and said outlets each have a frusto-conical configuration.

13. A screening device according to claim 12, wherein each said obstacle member extends along the width and above said screening element and at least a portion of said substantially cylindrical inlet extends within the obstacle member above said screening element.

* * * * *